US008596556B2

(12) United States Patent
Green

(10) Patent No.: US 8,596,556 B2
(45) Date of Patent: Dec. 3, 2013

(54) RADIATOR AND AIR COOLER MISTER

(75) Inventor: Michael Philip Green, Pleasant Hill, CA (US)

(73) Assignee: Vehicle Enhancement Labs, Bellflower, CA (US)

( * ) Notice: Subject to any disclaimer, the term of this patent is extended or adjusted under 35 U.S.C. 154(b) by 2652 days.

(21) Appl. No.: 11/062,287

(22) Filed: Feb. 22, 2005

(65) Prior Publication Data

US 2006/0185627 A1 Aug. 24, 2006

(51) Int. Cl.
*B05B 7/32* (2006.01)

(52) U.S. Cl.
USPC ..... 239/337; 239/132.3

(58) Field of Classification Search
USPC ..... 239/302, 333, 337, 349, 360, 569, 570, 239/548; 261/28, 58, 67, 72.1, 127
See application file for complete search history.

(56) References Cited

U.S. PATENT DOCUMENTS 3,878,989 A * 4/1975 Jenkins ..... 239/77
3,926,000 A * 12/1975 Scofield ..... 62/121
4,280,748 A * 7/1981 McHenney et al. ..... 439/620.26
5,046,327 A * 9/1991 Walker et al. ..... 62/244
5,528,900 A * 6/1996 Prasad ..... 62/175
5,620,633 A * 4/1997 Junkel et al. ..... 261/28
6,293,121 B1 * 9/2001 Labrador ..... 62/304
6,325,362 B1 * 12/2001 Massey et al. ..... 261/127
6,359,227 B1 * 3/2002 Oh et al. ..... 174/84 R
6,772,602 B2 * 8/2004 Vetter et al. ..... 62/239
6,789,787 B2 * 9/2004 Stutts ..... 261/28
6,899,282 B1 * 5/2005 Hill ..... 239/61

* cited by examiner

*Primary Examiner* — Davis Hwu
(74) *Attorney, Agent, or Firm* — Novak Druce Connolly Bove + Quigg LLP

(57) ABSTRACT

The present invention provides additional cooling assistance for automotive heat exchanging systems used for the cooling of liquids or air needed for engine operations. This operating system utilizes a liquid reservoir, an electric pump, a liquid transfer hose housing a directional flow valve, a spray nozzle, a liquid recycling tray mounted below the heat exchanger, a recycling liquid return hose, an electrical timed pulse relay circuit incorporated into a remotely mounted electrical on and off switch assembly, or the system can be automated with the incorporation of an adjustable thermostatic control sensor circuit. Under extreme operating conditions, a vehicle's engine can reach undesirable operating temperatures and when providing a mist of liquid to the frontal area of the heat exchanger, helps to stabilize or drop the engine's operating temperatures.

24 Claims, 4 Drawing Sheets

RADIATOR AND AIR COOLER MISTER

BACKGROUND OF INVENTION

1. Field of the Invention

This invention relates to a method and apparatus used strictly for the assisted cooling of external automotive heat exchangers used to cool a liquid or air during operations of an internal combustion engine.

2. Background of Related Art

The present invention relates to automotive engines reliant upon a heat exchanger system for engine heat dissipation. A typical type heat exchanger used for automotive applications is commonly referred to as a radiator which allows air to flow through a series of cooling fins attached to a series of incorporated inner liquid passageways, as air flows through the cooling fins heat is allowed to dissipate from a circulated cooling liquid housed inside these inner passageways. A vehicle when operating under extreme conditions collects heat build up internally within the engine due to internal fuel combustion. This heat is then transferred from the engine's internal metal structure into a sealed surrounding liquid jacket housing a constant flow of liquid needed to provide stabilization to the engine's temperature. This internal liquid is constantly circulated through the system once operational temperatures are achieved via a mechanical pumping system attached and driven by the engine. When the circulated cooling liquid arrives to the inlet of the radiator the cooling effect begins and typically after circulation through the radiator a normal temperature drop of approximately 30 degrees is achieved. During prolonged engine load demands and sometimes due to higher ambient air temperatures, engine combustion temperatures can rise contributing to increasing liquid temperatures. Under extreme temperature conditions, over-expansion of the liquid can occur and can potentially lead to a liquid boil-over situation. During these conditions the cooling liquid is allowed to escape from the system and if engine operations are allowed to continue even higher temperature are achieved due to cooling liquid loss. It is under these conditions if engine operations are not shut down, severe engine damage can result.

Under extreme engine operations, a simple solution to prevent and control overheating conditions is the practice of spraying a mist of water in front of the radiator. This method in most applications has proven to reduce engine temperatures an additional 20 degrees in approximately 1 minute.

In so far as known, other liquid misting methods or apparatus designed for other applications have multiple disadvantages if tried to be adapted to automotive applications:

1. Space for mounting such devices in most automotive applications is limited.
2. Due to limited reservoir mounting space, recycling of the liquid waste is critical for extending the liquid's replenishment range.
3. Electrical power needs to power said devices are limited to Direct Current only and electrical power provided has limitations due to other electrical obligations on the vehicle.
4. Other devices require the use of an incorporated fan to blow the liquid misting onto the object requiring cooling.

There truly exists a need for a dedicated liquid misting device strictly designed for automotive heat exchangers. Vehicles such as RV's and trucks used for towing constantly operate under extreme load demands and are considered a high risk for mechanical break downs due to engine overheating conditions.

BRIEF SUMMARY OF THE INVENTION

A pulsed mist of liquid sprayed onto the frontal area of a vehicle's radiator, oil or air cooler from a spray nozzle offers additional cooling protection when a vehicle's engine temperature starts to rise to an unsafe condition. The automotive misting method and apparatus consists of a liquid reservoir incorporating the use of an electric liquid pump and when switched on, an electrical circuit pulses timed electrical current to the electric pump. Using this method has proven to extend the liquid's operational range while reducing the routine for replenishment to the reservoir. The pumped liquid mist is transferred via a transfer tube or hose through a directional flow valve, (designed to prevent siphoning of the liquid from the reservoir when the system is not in operation), to a spray nozzle or to a series of spray nozzles depending on the size of the application. The spray nozzles are mounted in the grill or air intake area of the vehicle with the mounting location prior to the heat exchanger. The sprayed mist of liquid is dependant on incoming air flow to help the liquid atomize with the air and push the spray onto and through the cooling fins of the heat exchanger. A liquid recycling tray is further utilized and mount below the heat exchanger on a paralleling angle with angled deflection extensions extending outwards and are designed to catch excessive liquid run off, (due to applying to much liquid to the heat exchange). This collected liquid run off is trapped and transferred back to the liquid reservoir via a drain hose connection located at an incorporated low point in the floor of the recycling tray. This trapped liquid is then transferred back to the reservoir due to vacuum created by the non-venting of the reservoir and the pumping action of the liquid to the spray nozzle.

BRIEF DESCRIPTION OF THE DRAWS

DETAILED DESCRIPTION OF THE INVENTION

Figure 1:
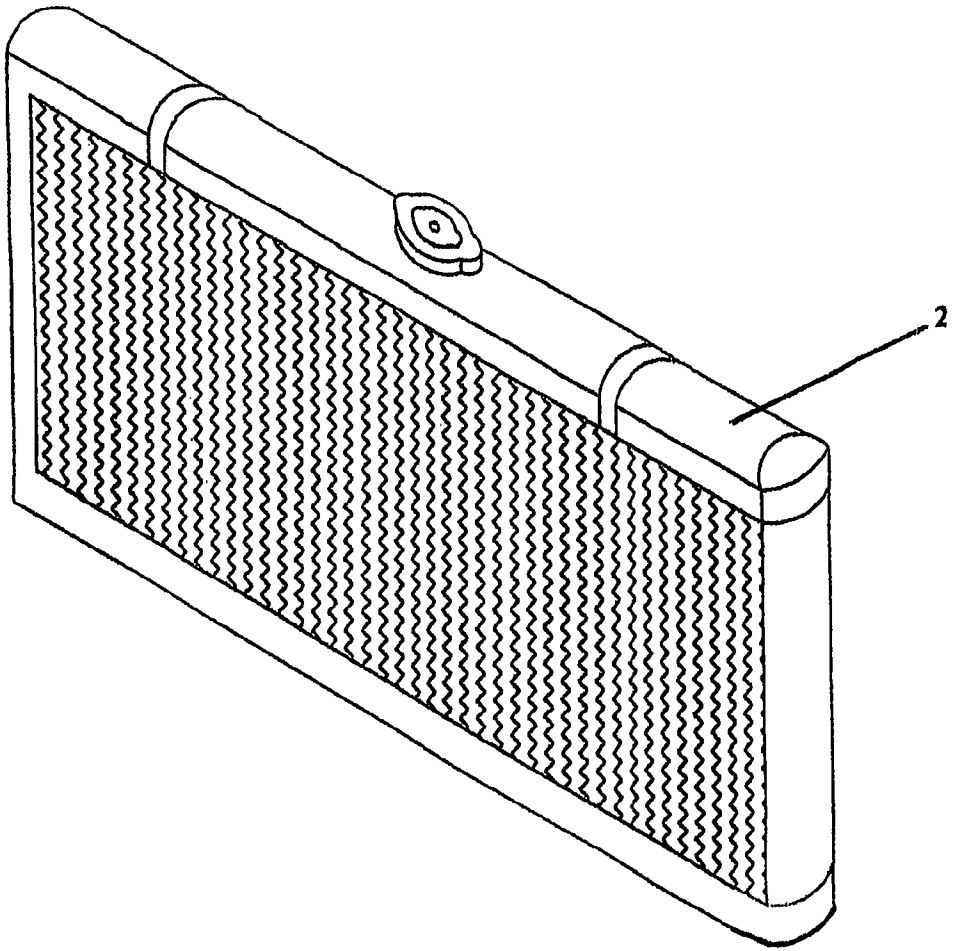
FIG. 1 illustrates a perspective view of the related art.

FIG. 1 illustrates a perspective view of the present invention's related art. The heat exchanger 2 is utilized to cool circulated liquid needed for temperature stabilization in an internal combustion engine or other heat generating drive train components dependent on liquid or air cooling.

Figure 2:
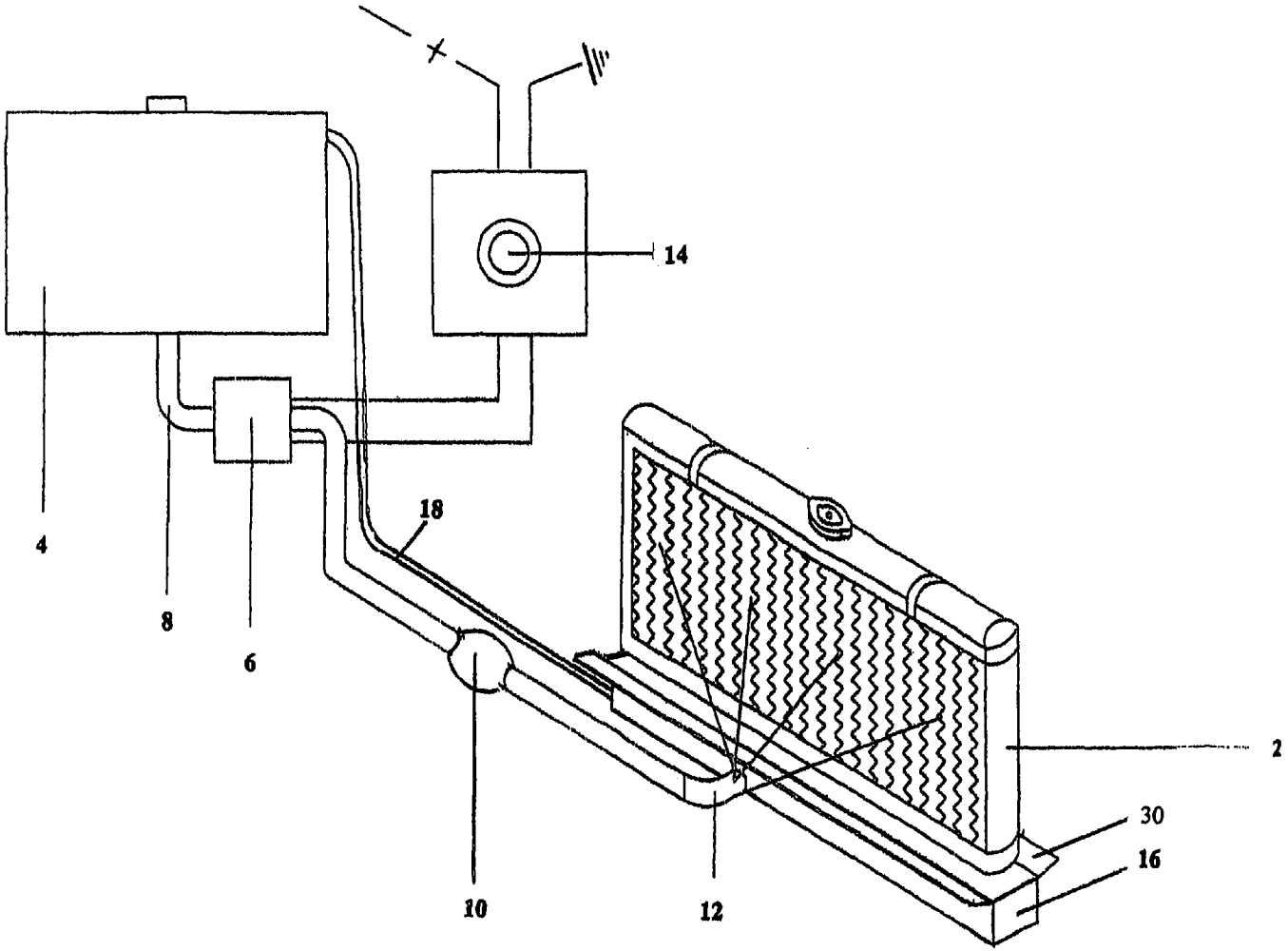
FIG. 2 illustrates a working perspective view of the manually operated system.

FIG. 2 illustrates an operational overview of the present invention when utilizing a manually operated electrical switch circuit. An airtight liquid reservoir 4, housing a predetermine amount of liquid is utilized for supplying a mist of water to the frontal area of an automotive heat exchanger 2. A transfer tube or hose 8, transfers the misting liquid via an electrical liquid pump 6 through a directional flow valve 10 prior to exiting out the spray nozzle 12. The spray nozzle 12 mounts inside the grill or air intake area of the vehicle prior to the front of the heat exchanger and is dependant upon incoming air flow to transfer the sprayed liquid mist onto the heat exchanger 2. Electrical power to the electric pump 6 is pulsed via a remotely mounted switch circuit 14 which is generally mounted inside the cab of the vehicle. The switch circuit 14 when switched on uses a power width modulator incorporated into its circuitry and used to deliver intervals of time duration pulses of electric power to the electric pump 6. Once engaged any excessive liquid run off from the heat exchanger 2 is caught in a recycling tray 16 mounted and running parallel below the heat exchanger 2, the recycling tray 16 incorporates a series of angled deflection extensions 30 to help catch and guide liquid run off into the recycling tray's sump. A liquid return tube or hose 18 connects to an incorporated low point on the recycling tray 16 and allows the trapped liquid to be transferred back to the liquid reservoir 4 using a vacuum source created by the non-venting of the reservoir 4 and the pumping action of the electric pump 6 when operational.

Figure 3:
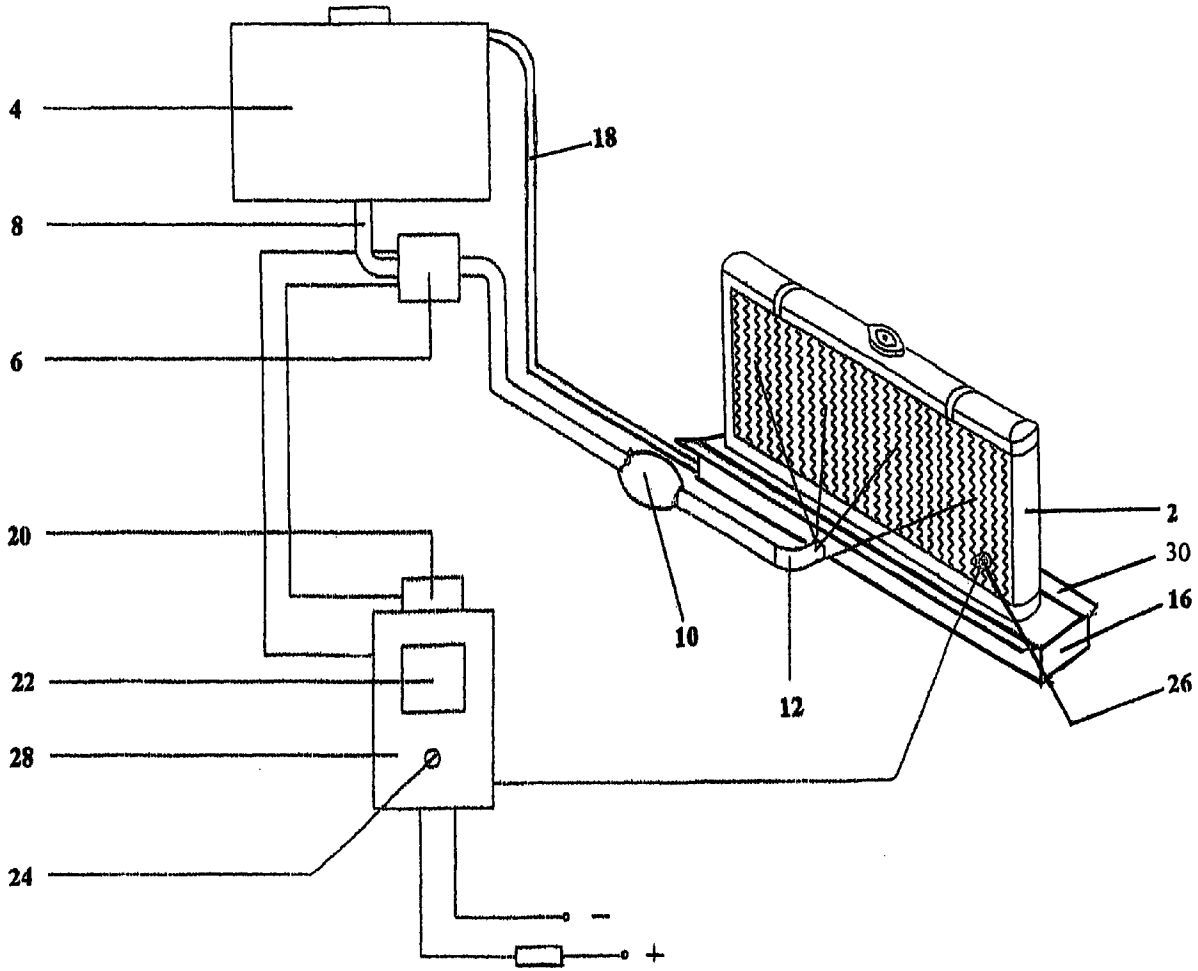
FIG. 3 illustrates a working perspective view of an automated operated system.

FIG. 3 illustrates the same operational system as FIG. 2 but incorporates a thermistor heat sensing device with an adjustable temperature circuit. The control box 28 houses an adjustable power modulator 20 used to increase or decrease the frequency of timed duration pulses of electrical power to the liquid electric pump 6. The thermistor circuit 22 is further housed inside the control box 28 and allows control to manually adjustable a range of high and low temperature settings 24. The thermistor temperature probe 26 pushes in between the cooling fins and houses itself as part of the heat exchanger 2. The thermistor 26 is used to measure the resistance of passing direct current voltage, (dc) through its circuitry. The change in resistance due to an increase or decrease of temperature is relayed back to the control box 28 and once the designated temperature is reached the system is activated. Once the system achieves its normal operating temperature the system is than deactivated and shuts down.

Figure 4:
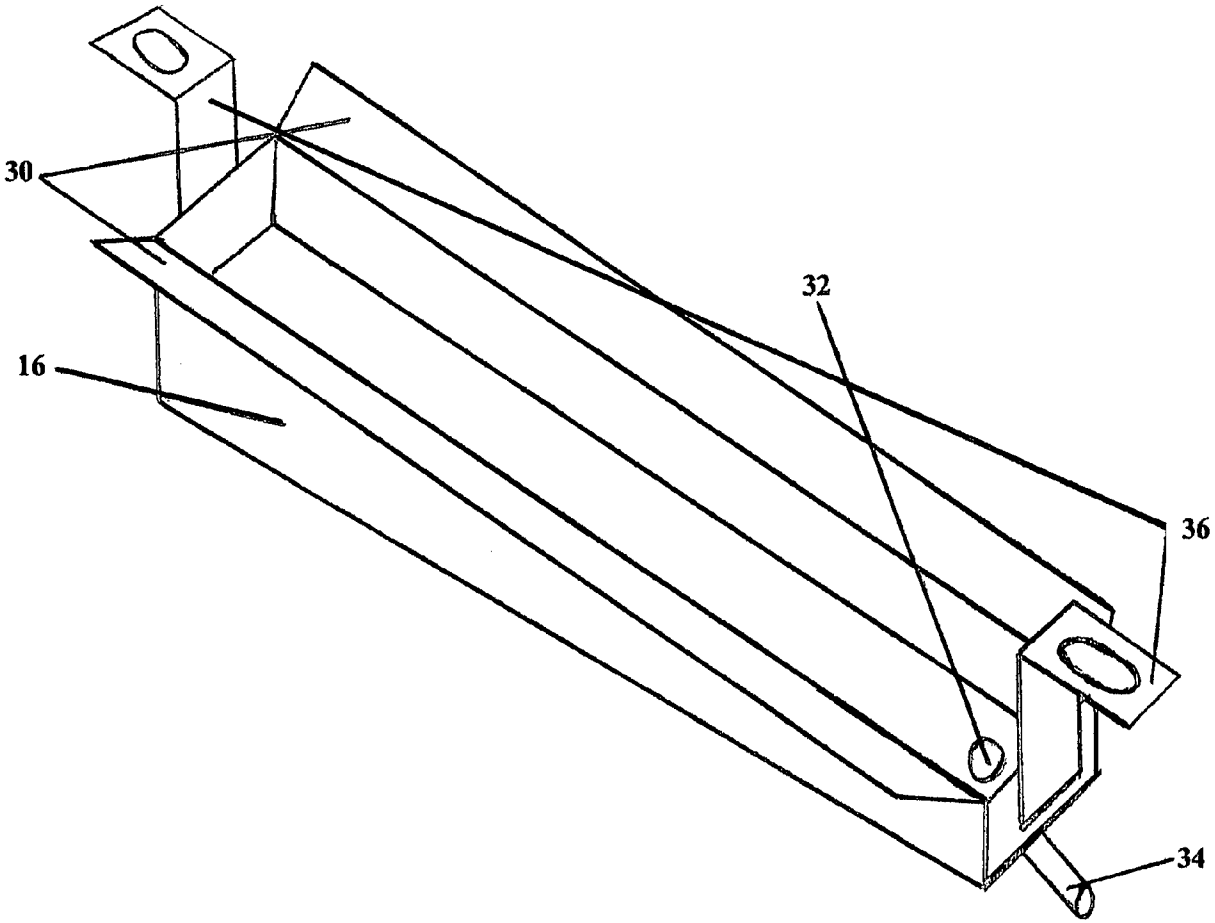
FIG. 4 illustrates a perspective view of the recycling tray system.

FIG. 4 illustrates the design of the liquid recycling tray 16. The tray during construction incorporates a slight lope to the bottom of the tray which allows the trapped liquid to drain towards a drain hole 32. Incorporated as part of the drain hole is a provision for a hose connection 34 which allows the connection of a return tube or hose back to the liquid reservoir. Liquid re-circulation is dependent on a vacuum or suction created during the pumping action of the electric pump which pulls the liquid from the recycling tray 16 back to the reservoir. Extending outward and on approximately a 45 degree angle are a forward and back facing ledge 30 which helps to collect and guides normally waste liquid into the trough of the liquid recycling tray 16. Also incorporated as part of the construction of the recycling tray 16 are a series of provisions for mounting brackets 36 which allows the mounting of the tray directly under and running parallel with the heat exchanger.

What is claimed is:

1. An air cooler misting unit for an automotive or industrial engine cooling system, the unit comprising:

(a) a heat exchanger wherein an internally flowing hot liquid is cooled by flow of air over an external surface of the heat exchanger;

(b) a liquid holding tank for storing a liquid which is used for spraying a mist of liquid into the air which flows over the external surface of the heat exchanger;

(c) a liquid delivery conduit that delivers the liquid from the holding tank to at least one spray jet;

(d) at least one spray jet for misting the liquid into the flow of the air;

(e) a pump for moving the liquid through the conduit from the holding tank to the at least one spray jet, (f) a one way flow valve positioned in the liquid delivery conduit between the holding tank and the at least one spray iet to stop the liquid in the holding tank from siphoning out;

(g) an on an off switch which supplies the pump with power to move the liquid from the holding tank to the spray jet; and, (h) an electrical wire to supply power from the switch to the pump and a linkable fuse for the purpose of protecting the electrical system in case of an overload condition.

2. The misting unit of claim 1, where the liquid holding tank further comprises a liquid filler opening sealed by a filler cap, an incorporated hose outlet and a secondary hose inlet and a series of mounts to mount the holding tank.

3. The misting unit of claim 2, where the liquid delivery conduit comprises a liquid transfer hose.

4. The misting unit of claim 2, where the on and off circuit is operatively connected to a heat sensor for the purpose of turning the switch button on and off.

5. The misting unit of claim 2, further comprising a computer to operate the on and off switch in conjunction with an automated adjustable thermostatic control circuit utilizing a heat sensor attaching to either an engine operatively coupled to the heat exchanger, or to the heat exchanger, which activates or deactivates the switch when achieving a series of pre-determined temperature settings.

6. The misting unit of claim 2, where the on and off switch is a manual switch.

7. The misting unit of claim 2, where the mist of liquid is sprayed directly on the heat exchanger.

8. The misting unit of claim 2, where the heat exchanger is a radiator of a motor vehicle.

9. The misting unit of claim 2, where the misting liquid is water.

10. The misting unit of claim 2, where the spray jets comprise a rotating fan.

11. The misting of claim 2, where the spray jets are incorporated into a spray fan blade.

12. The misting unit of claim 2, further comprising a source of compressed air and a mixer for mixing the compressed air with the misting liquid.

13. The misting unit of claim 2, wherein the spray jets surround the heat exchanger.

14. The misting unit of claim 13, where the heat exchanger is a radiator of a motor vehicle, and the spray jets surround the radiator.

15. The misting unit of claim 14, where each spray jet comprises a mounting bracket.

16. The misting unit of claim 2, where each spray jet comprises a rubber material.

17. The misting unit of claim 2, where the liquid holding tank comprises a series of outlets.

18. The misting unit of claim 1, where the pump is mounted in the holding tank.

19. The misting unit of claim 1, where the pump is mounted downstream of the holding tank and the one way flow valve is between the pump and the at least one spray jet.

20. The misting unit of claim 18, where the one way flow valve is mounted at an exit point of the tank.

21. The misting unit of claim 1, where the one way flow valve is mounted at an entrance of each of the at least one spray jet.

22. The air cooling misting unit of claim 8, where the automotive or industrial engine further comprises an intake air cooler and the misting unit further comprises a means to spray a mist of liquid onto the intake air cooler.

23. The misting unit of claim 1, further comprising a recycling tray to catch any liquid runoff of misting liquid.

24. The misting unit of claim 23, further comprising a liquid return tube fluidly connected between the recycling tray and the holding tank.

* * * * *